US011618123B2

(12) United States Patent
Ishii et al.

(10) Patent No.: US 11,618,123 B2
(45) Date of Patent: Apr. 4, 2023

(54) POLISHING METHOD AND POLISHING APPARATUS

(71) Applicant: EBARA CORPORATION, Tokyo (JP)

(72) Inventors: Yu Ishii, Tokyo (JP); Tetsuji Togawa, Tokyo (JP); Atsushi Yoshida, Tokyo (JP)

(73) Assignee: EBARA CORPORATION, Toyko (JP)

( * ) Notice: Subject to any disclaimer, the term of this patent is extended or adjusted under 35 U.S.C. 154(b) by 189 days.

(21) Appl. No.: 17/072,870

(22) Filed: Oct. 16, 2020

(65) Prior Publication Data

US 2021/0170541 A1 Jun. 10, 2021

(30) Foreign Application Priority Data

Oct. 25, 2019 (JP) ..... JP2019-194182

(51) Int. Cl.
*B24B 37/005* (2012.01)
*B24B 49/16* (2006.01)

(52) U.S. Cl.
CPC ..... *B24B 37/005* (2013.01); *B24B 49/16* (2013.01)

(58) Field of Classification Search
CPC ... B24B 37/105; B24B 37/013; B24B 37/005; B24B 49/02; B24B 49/16; B24B 7/228
USPC ..... 451/5, 9–11, 272–274, 393, 394
See application file for complete search history.

(56) References Cited

U.S. PATENT DOCUMENTS 5,639,388 A * 6/1997 Kimura ..... B24B 37/013 216/84
6,180,020 B1 * 1/2001 Moriyama ..... B24B 37/04 257/E21.244
6,494,765 B2 * 12/2002 Gitis ..... B24B 49/10 451/287
7,097,534 B1 * 8/2006 Yampolskiy ..... B24B 37/013 451/28

(Continued)

FOREIGN PATENT DOCUMENTS

JP H08-197417 A 8/1996
JP H09-262743 A 10/1997

(Continued)

OTHER PUBLICATIONS

European Patent Application No. 20203265.2; Extended Search Report; dated Mar. 29, 2021; 7 pages.

*Primary Examiner* — Joel D Crandall
*Assistant Examiner* — Jason Khalil Hawkins
(74) *Attorney, Agent, or Firm* — BakerHostetler

(57) ABSTRACT

A polishing method capable of accurately determining a polishing end point of a substrate is disclosed. The method comprises: rotating a polishing table supporting a polishing pad; and polishing the substrate by pressing the substrate against a polishing surface of the polishing pad by a polishing head, wherein polishing the substrate includes: an oscillation polishing process of polishing the substrate while causing the polishing head to oscillate along the polishing surface; and a static polishing process of polishing the substrate with the oscillation of the polishing head stopped, the static polishing process is performed after the oscillation polishing process, and the static polishing process comprises determining a static polishing end point which is a point in time at which a rate of change of torque for rotating the polishing table has reached a change-rate threshold value.

12 Claims, 10 Drawing Sheets

(56) References Cited

U.S. PATENT DOCUMENTS

| | | | | |
|---|---|---|---|---|
| 7,238,087 | B1 * | 7/2007 | Kashiwa | B24B 41/005 451/287 |
| 8,353,738 | B2 * | 1/2013 | Molnar | G06Q 50/04 702/182 |
| 9,272,389 | B2 * | 3/2016 | Takahashi | B24B 37/042 |
| 9,308,618 | B2 * | 4/2016 | Benvegnu | B24B 49/10 |
| 10,029,346 | B2 * | 7/2018 | Ala | B24B 37/32 |
| 10,350,723 | B2 * | 7/2019 | Shen | B24B 37/105 |
| 11,097,397 | B2 * | 8/2021 | Watanabe | B24B 37/20 |
| 2008/0081540 | A1 * | 4/2008 | Sato | H01L 21/67219 451/178 |
| 2011/0300775 | A1 * | 12/2011 | Zhang | B24B 49/12 451/6 |
| 2015/0017880 | A1 * | 1/2015 | Nomura | H01L 22/26 451/6 |
| 2018/0250788 | A1 * | 9/2018 | Lau | B24B 49/10 |

FOREIGN PATENT DOCUMENTS

| | | | |
|---|---|---|---|
| JP | 2003-318140 | A | 11/2003 |
| JP | 2008-110471 | A | 5/2008 |
| JP | 2018-144227 | A | 9/2018 |

* cited by examiner

POLISHING METHOD AND POLISHING APPARATUS

CROSS REFERENCE TO RELATED APPLICATION

This document claims priority to Japanese Patent Application Number 2019-194182 filed Oct. 25, 2019, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique for a surface of the semiconductor device is becoming more important. The most important technique in this surface planarization is chemical mechanical polishing (CMP). This chemical mechanical polishing (which will be hereinafter called CMP) is a process of polishing a substrate, such as a wafer, by placing the substrate in sliding contact with a polishing surface of a polishing pad while supplying a polishing liquid containing abrasive grains, such as silica ($SiO_2$), onto the polishing surface. As the substrate to be polished, not only a circular substrate, such as a wafer, but also a square substrate, such as a printed wiring (circuit) substrate (PCB) having a dielectric material or wiring on the surface, exists.

A polishing apparatus for performing CMP includes a polishing table that supports a polishing pad having a polishing surface, and a polishing head for holding the substrate. In such a polishing apparatus, the polishing table and the polishing head are relatively moved, and the substrate is pressed against the polishing surface of the polishing pad by the polishing head while a polishing liquid, such as a slurry, is supplied onto the polishing surface of the polishing pad. A surface of the substrate is in sliding contact with the polishing surface in the presence of the polishing liquid, so that the surface of the substrate is polished to a flat and mirror surface by a chemical action of the polishing liquid and a mechanical action of abrasive grains contained in the polishing liquid.

The substrate, such as a wafer, has a multilayered structure composed of different materials, such as semiconductor, conductor, and dielectric material. A frictional force that acts between the substrate and the polishing pad changes depending on a material of the surface, to be polished, of the substrate. Therefore, a conventional method for determining a polishing end point includes detecting a change in the frictional force caused by a transition of a material of the surface, to be polished, of the substrate to a different material, and determining the polishing end point based on a point in time at which the frictional force changes. The frictional force acts at a position away from a center of rotation (axis) of the polishing table. Therefore, the change in the frictional force can be detected as a change in torque for rotating the polishing table. When a device for rotating the polishing table is an electric motor, the torque can be measured as a current flowing into the electric motor.

In the above-described polishing apparatus, the substrate may be polished while the polishing head oscillates (or reciprocates) along the polishing surface of the polishing pad from a viewpoint of improvement of polishing performance and productivity, etc. FIG. 9 is a diagram showing a change in the torque for rotating the polishing table when the substrate is polished with no oscillation of the polishing head. In the example shown in FIG. 9, as the polishing of the substrate progresses, the torque for rotating the polishing table gradually decreases, until the torque becomes constant at about 80 seconds (point A in the figure). This indicates that a material of the surface to be polished has changed at about 80 seconds. Therefore, the polishing end point can be determined based on a point in time at which the torque becomes constant (i.e., the point A in the figure).

FIG. 10 is a diagram showing a change in the torque for rotating the polishing table when a substrate equivalent to the substrate in FIG. 9 is polished while the polishing head is oscillating along the polishing surface of the polishing pad. When the polishing head is oscillating along the polishing surface of the polishing pad, the position on the polishing pad at which the frictional force acts changes. A torque required to rotate the polishing table at a constant speed changes depending on a distance from the axis of the polishing table to a position where the frictional force acts (i.e., a position of the polishing head). Therefore, as shown in FIG. 10, when the polishing head is oscillating during polishing of the substrate, the torque fluctuates greatly, and the polishing end point may not be accurately determined.

SUMMARY OF THE INVENTION

Therefore, there are provided a polishing method and a polishing apparatus capable of accurately determining a polishing end point of a substrate while including a process of causing a polishing head to oscillate along a polishing surface of a polishing pad.

Embodiments, which will be described below, relate to a polishing method and a polishing apparatus for polishing a substrate, such as a wafer, and more particularly to a method and an apparatus for polishing the substrate by pressing the substrate against a polishing pad on a polishing table with a polishing head while causing oscillation of the polishing head.

In an embodiment, there is provided a method of polishing a substrate, comprising: rotating a polishing table supporting a polishing pad; and polishing the substrate by pressing the substrate against a polishing surface of the polishing pad by a polishing head, wherein polishing the substrate includes: an oscillation polishing process of polishing the substrate while causing the polishing head to oscillate along the polishing surface; and a static polishing process of polishing the substrate with the oscillation of the polishing head stopped, the static polishing process is performed after the oscillation polishing process, and the static polishing process comprises determining a static polishing end point which is a point in time at which a rate of change of torque for rotating the polishing table has reached a change-rate threshold value.

In an embodiment, polishing the substrate comprises an oscillation stop operation which stops the oscillation of the polishing head after the torque has reached a preset torque threshold value or after a current polishing time has reached a preset oscillation polishing time.

In an embodiment, the oscillation stop operation comprises stopping the oscillation of the polishing head when the polishing head is at a preset stop position above the polishing table.

In an embodiment, determining the static polishing end point comprises determining the static polishing end point which is a point in time at which the rate of change decreases to reach the change-rate threshold value.

In an embodiment, determining the static polishing end point comprises determining the static polishing end point which is a point in time at which the rate of change increases to reach the change-rate threshold value.

In an embodiment, polishing the substrate further comprises a finish polishing process performed after the static polishing process, and the finish polishing process comprises determining a finish polishing end point which is a point in time at which a finish polishing time has elapsed, the finish polishing time is determined based on the static polishing end point.

In an embodiment, the finish polishing process comprises polishing the substrate while causing the polishing head to oscillate along the polishing surface.

In an embodiment, the polishing head is on an axis of the polishing table while the polishing head is oscillating.

In an embodiment, there is provided a method of polishing a substrate, comprising: rotating a polishing table supporting a polishing pad; and polishing the substrate by pressing the substrate against a polishing surface of the polishing pad by a polishing head while causing the polishing head to oscillate along the polishing surface, wherein polishing the substrate includes: measuring a torque for rotating the polishing table while polishing the substrate; determining a plurality of representative values of the torque from a plurality of measured values of the torque; generating a relational expression expressing relationship between the plurality of representative values of the torque and polishing time; and determining a first polishing end point which is a point in time at which a predicted value of the torque, calculated from the relational expression, reaches a torque threshold value.

In an embodiment, the plurality of representative values of the torque are a plurality of local minimum values of the torque, a plurality of local maximum values of the torque, or a plurality of moving average values of the torque.

In an embodiment, polishing the substrate comprises determining a second polishing end point which is a point in time at which a finish polishing time has elapsed, the finish polishing time is determined based on the first polishing end point.

In an embodiment, the polishing head is on an axis of the polishing table while the polishing head is oscillating.

In an embodiment, there is provided a polishing apparatus for polishing a substrate, comprising: a polishing table for supporting a polishing pad; a table motor configured to rotate the polishing table; a torque measuring device configured to measure a torque for rotating the polishing table; a polishing head configured to polish the substrate by pressing the substrate against a polishing surface of the polishing pad; a polishing-head oscillation arm coupled to the polishing head; an oscillation motor coupled to the polishing-head oscillation arm and configured to cause the polishing head to oscillate along the polishing surface; and an operation controller configured to control an operation of the polishing apparatus, wherein the operation controller is configured to: instruct the polishing apparatus to perform an oscillation polishing process of polishing the substrate while rotating the polishing table and causing the polishing head to oscillate along the polishing surface; instruct the polishing apparatus to perform, after the oscillation polishing process, a static polishing process of polishing the substrate while rotating the polishing table with the oscillation of the polishing head stopped, and determine a static polishing end point which is a point in time at which a rate of change of the torque for rotating the polishing table has reached a change-rate threshold value during the static polishing process.

In an embodiment, the operation controller is configured to instruct the oscillation motor to stop the oscillation of the polishing head after the torque has reached a preset torque threshold value or after a current polishing time has reached a preset oscillation polishing time.

In an embodiment, the operation controller is configured to instruct the oscillation motor to stop the oscillation of the polishing head when the polishing head is at a preset stop position above the polishing table.

In an embodiment, the operation controller is configured to: instruct the polishing apparatus to perform, after the static polishing process, a finish polishing process of polishing the substrate while rotating the polishing table; and determine a finish polishing end point during the finish polishing process, the finish polishing end point is a point in time at which a finish polishing time has elapsed, the finish polishing time is determined based on the static polishing end point.

In an embodiment, the polishing head is on an axis of the polishing table.

In an embodiment, there is provided a polishing apparatus comprising: a polishing table for supporting a polishing pad; a table motor configured to rotate the polishing table; a torque measuring device configured to measure a torque for rotating the polishing table; a polishing head configured to press a substrate against a polishing surface of the polishing pad; a polishing-head oscillation arm coupled to the polishing head; an oscillation motor coupled to the polishing-head oscillation arm and configured to cause the polishing head to oscillate along the polishing surface; and an operation controller configured to acquire a plurality of measured values of the torque from the torque measuring device, determine a plurality of representative values of the torque from a plurality of measured values of the torque, generate a relational expression expressing relationship between the plurality of representative values of the torque and polishing time, and determine a first polishing end point which is a point in time at which a predicted value of the torque, calculated from the relational expression, reaches a torque threshold value.

In an embodiment, the plurality of representative values of the torque are a plurality of local minimum values of the torque, a plurality of local maximum values of the torque, or a plurality of moving average values of the torque.

In an embodiment, the operation controller is configured to determine a second polishing end point which is a point in time at which a finish polishing time has elapsed, the finish polishing time is determined based on the first polishing end point.

In an embodiment, the polishing head is on an axis of the polishing table.

According to an embodiment, the polishing apparatus polishes the substrate while causing the polishing head to oscillate, then stops the oscillation of the polishing head, and determines the static polishing end point which is a point in time at which the rate of change of the torque for rotating the polishing table has reached the change-rate threshold value while polishing the substrate with the oscillation of the polishing head stopped.

Further, the polishing apparatus calculates the predicted value of the torque based on the plurality of measured values of the torque, and determines the first polishing end point which is a point in time at which the predicted value reaches the torque threshold value based on the predicted value.

As a result, a polishing end point can be accurately determined based on the static polishing end point or the first polishing end point.

DESCRIPTION OF EMBODIMENTS

Figure 1:
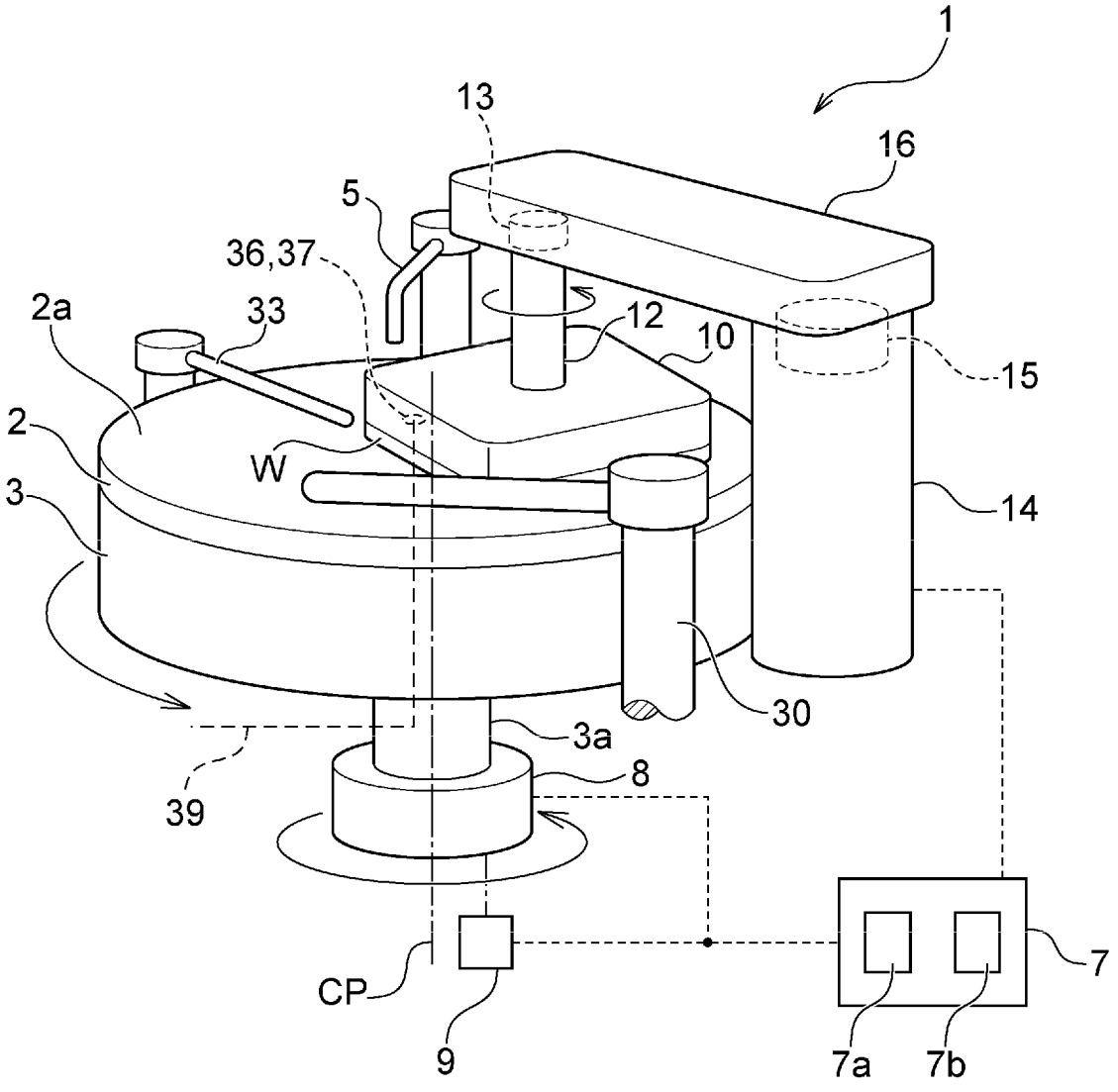
FIG. 1 is a schematic view showing an embodiment of a polishing apparatus.

Embodiments will be described in detail below with reference to the drawings. FIG. 1 is a schematic view showing an embodiment of a polishing apparatus. A polishing apparatus 1 shown in FIG. 1 is suitably used as a polishing apparatus for polishing a quadrangular substrate.

As shown in FIG. 1, the polishing apparatus 1 includes a polishing head 10 for holding and rotating a substrate W, a polishing table 3 for supporting a polishing pad 2 thereon, a table motor 8 for rotating the polishing table 3, a polishing-head oscillation arm 16 coupled to an upper end of a support shaft 14, a polishing-head shaft 12 attached to a free end of the polishing-head oscillation arm 16, and an operation controller 7 for controlling an operation of each device of the polishing apparatus 1. The polishing-head oscillation arm 16 is located above the polishing table 3, and is disposed in parallel with a polishing surface 2*a* of the polishing pad 2. The substrate W of this embodiment is a quadrangular substrate, such as a printed wiring (circuit) substrate (PCB) having a dielectric material or wiring on its surface. The polishing head 10 has a quadrangular shape. The shapes of the substrate W and the polishing head 10 are not limited to this embodiment. In one embodiment, the substrate W may be a circular wafer and the polishing head 10 may be circular in shape. The polishing head 10 is coupled to a lower end of the polishing-head shaft 12, and is configured to be able to hold the substrate W on a lower surface thereof by vacuum suction. The polishing-head oscillation arm 16 is coupled to the polishing head 10 through the polishing-head shaft 12, and the polishing head 10 is supported by the polishing-head oscillation arm 16.

The operation controller 7 is constituted by at least one computer. The operation controller 7 includes a memory 7*a* storing programs therein, and an arithmetic device 7*b* that performs arithmetic operations according to instructions contained in the programs. The arithmetic device 7*b* includes a CPU (central processing unit), a GPU (graphics processing unit), or the like that performs the arithmetic operations according to the instructions contained in the programs stored in the memory 7*a*. The memory 7*a* includes a main memory (for example, a random-access memory) accessible by the arithmetic device 7*b*, and an auxiliary memory (for example, a hard-disk drive or a solid-state drive) that stores data and programs therein.

The polishing apparatus 1 further includes a polishing-head rotating motor 13 coupled to the polishing-head shaft 12. In this embodiment, the polishing-head rotating motor 13 is disposed inside the polishing-head oscillation arm 16, while in one embodiment, the polishing-head rotating motor 13 may be disposed outside the polishing-head oscillation arm 16. Specifically, the polishing-head rotating motor 13 may be disposed above the polishing-head oscillation arm 16, and a rotating shaft of the polishing-head rotating motor 13 may extend through the polishing-head oscillation arm 16 and may be coupled to the polishing-head shaft 12.

The polishing-head shaft 12 is configured to be rotatable by the polishing-head rotating motor 13. Due to the rotation of this polishing-head shaft 12, the polishing head 10 rotates about the polishing-head shaft 12 in a direction indicated by an arrow in the figure. The polishing-head shaft 12 is coupled to an elevating device (not shown). The polishing head 10 is elevated and lowered by the elevating device through the polishing-head shaft 12.

The polishing apparatus 1 further includes an oscillation motor 15 coupled to the polishing-head oscillation arm 16. In this embodiment, the oscillation motor 15 is disposed inside the support shaft 14. The polishing-head oscillation arm 16 is configured to be rotatable around the support shaft 14 by the oscillation motor 15. The polishing head 10 moves between a position (not illustrated) for receiving the substrate W and a position above the polishing table 3 with the pivoting motion of the polishing-head oscillation arm 16. In one embodiment, the polishing-head oscillation arm 16 may be fixed to the support shaft 14 and the oscillation motor 15 may be coupled to the support shaft 14.

The polishing pad 2 is attached to an upper surface of the polishing table 3, and the polishing pad 2 is configured to rotate together with the polishing table 3. An upper surface of the polishing pad 2 provides a polishing surface 2*a* for polishing the substrate W. The polishing table 3 is coupled to the table motor 8 arranged below the polishing table 3 through a table shaft 3*a*. The polishing table 3 is configured to be rotatable around the table shaft 3*a* by the table motor 8 in a direction indicated by an arrow. More specifically, an axis CP of the polishing table 3 and an axis of the table shaft 3*a* coincide with each other, and the polishing table 3 rotates about the axis CP. An example of the table motor 8 may include a variable-speed motor having an inverter.

The polishing apparatus 1 further includes a torque measuring device 9 for measuring a torque for rotating the polishing table 3. The torque measuring device 9 is coupled to the table motor 8. During polishing of the substrate W, the polishing table 3 is driven by the table motor 8 so as to rotate at a constant speed. Therefore, when a torque required to rotate the polishing table 3 at the constant speed changes, a drive current for the table motor 8 changes.

The torque for rotating the polishing table 3 is a moment of force for rotating the polishing table 3 around its axis CP. The torque for rotating the polishing table 3 corresponds to the drive current for the table motor 8. Therefore, in this embodiment, the torque measuring device 9 is a current measuring device for measuring the drive current for the table motor 8. In one embodiment, the torque measuring device 9 may be constituted by at least a part of a motor driver for driving the table motor 8. In this case, the motor driver determines a current value necessary for rotating the polishing table 3 at a constant speed, and outputs the determined current value. The determined current value corresponds to the torque for rotating the polishing table 3. In one embodiment, the torque measuring device 9 may be a torque measuring device configured to directly measure the torque for rotating the polishing table 3 around its axis CP.

The polishing apparatus 1 further includes a dresser 30 for conditioning the polishing pad 2, a dressing-liquid supply nozzle 5 for supplying a dressing liquid to the polishing pad 2, and an atomizer 33 for ejecting a liquid, or a fluid mixture of a liquid and a gas toward the polishing pad 2. An example of the dressing liquid may include pure water. The liquid ejected from the atomizer 33 may be, for example, pure water, and the gas ejected from the atomizer 33 may be, for example, nitrogen gas.

A polishing-liquid supply passage 39 for supplying a polishing liquid is provided in the polishing table 3 and the table shaft 3*a*. One end of the polishing-liquid supply passage 39 is in fluid communication with a polishing-liquid supply hole 36 formed in the surface of the polishing table 3, and the other end is coupled to a polishing-liquid supply source (not shown). At a position corresponding to the polishing-liquid supply hole 36 of the polishing table 3, a polishing-liquid supply hole 37 is formed in the polishing pad 2. During polishing of the substrate W, the polishing liquid flows through the polishing-liquid supply passage 39 and the polishing-liquid supply hole 36, and is supplied from the polishing-liquid supply hole 37 to the polishing surface 2*a* of the polishing pad 2. An example of the polishing liquid may include slurry containing abrasive grains. Although FIG. 1 shows one set of polishing-liquid supply holes 36 and 37, the polishing apparatus 1 may include a plurality of sets of polishing-liquid supply holes 36 and 37. The polishing-liquid supply holes 36 and 37 are arranged on the axis CP of the polishing table 3 or near the axis CP.

Figure 2:
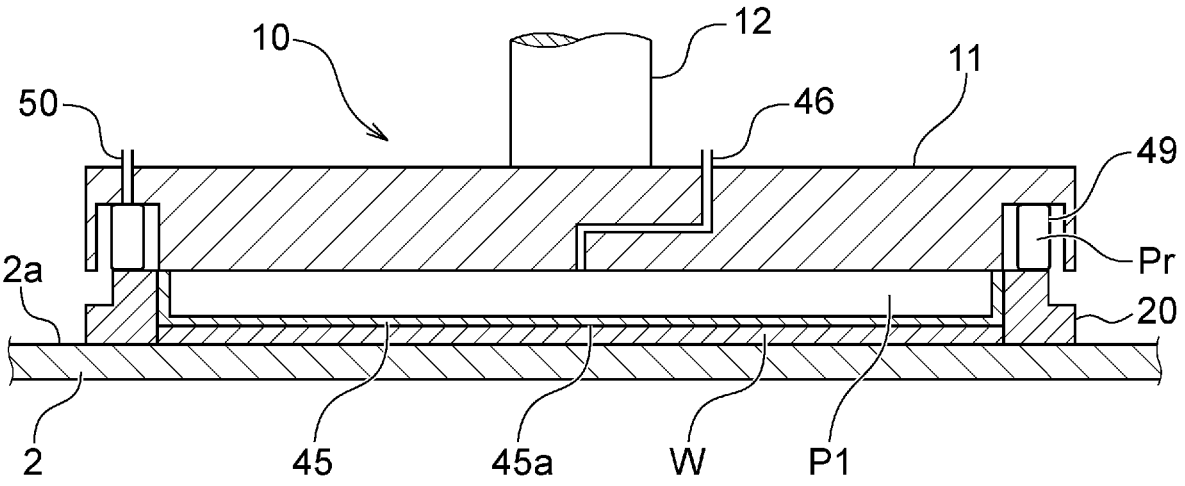
FIG. 2 is a cross-sectional view of a polishing head shown in FIG. 1.

FIG. 2 is a cross-sectional view of the polishing head 10 shown in FIG. 1. The polishing head 10 includes an elastic membrane 45 for pressing the substrate W against the polishing surface 2*a* of the polishing pad 2, a head body 11 holding the elastic membrane 45, and a retainer member 20 disposed below the head body 11. The elastic membrane 45 is attached to a lower part of the head body 11. The head body 11 is fixed to the end of the polishing-head shaft 12. The head body 11, the elastic membrane 45, and the retainer member 20 are configured to rotate together by the rotation of the polishing-head shaft 12. The retainer member 20 is configured to be vertically movable relative to the head body 11. The head body 11 of this embodiment has a quadrangular shape and is made of a resin, such as engineering plastic (for example, PEEK).

A lower surface of the elastic membrane 45 provides a substrate pressing surface 45*a* for pressing the substrate W against the polishing surface 2*a* of the polishing pad 2. The retainer member 20 is disposed so as to surround the substrate pressing surface 45*a*. The substrate W is surrounded by the retainer member 20. A pressure chamber (or an airbag) P1 is provided between the elastic membrane 45 and the head body 11. The pressure chamber P1 is formed by the elastic membrane 45 and the head body 11. Pressurized fluid, such as pressurized air, is supplied into the pressure chamber P1 through a fluid passage 46, or the pressure chamber P1 is evacuated.

In the embodiment shown in FIG. 2, the pressure chamber P1 is formed over an entire upper surface of the substrate W. In one embodiment, the elastic membrane 45 and the head body 11 may form a plurality of pressure chambers. In the case where such a plurality of pressure chambers are formed, a fluid passage which communicates with each pressure chamber may be provided so that a pressure in each pressure chamber is controlled independently. The elastic membrane 45 is made of a rubber material having excellent strength and durability, such as ethylene propylene rubber (EPDM), polyurethane rubber, or silicone rubber.

The retainer member 20 is arranged around the elastic membrane 45, and the retainer member 20 is placed in contact with the polishing surface 2*a* of the polishing pad 2 during polishing of the substrate W. The retainer member 20 is arranged so as to surround the peripheral edge of the substrate W, and prevents the substrate W from coming off from the polishing head 10 during polishing of the substrate W. The retainer member 20 of this embodiment has a quadrangular annular shape corresponding to the quadrangular substrate W, but the shape of the retainer member 20 is not limited to the shape of this embodiment. The retainer member 20 may be made of a highly rigid resin material, ceramics, or the like.

An annular elastic bag 49 is arranged between the retainer member 20 and the head body 11. A pressure chamber Pr is formed inside the elastic bag 49. The retainer member 20 is vertically movable relative to the head body 11 by expansion/contraction of the elastic bag 49. The elastic bag 49 expands to press a lower surface of the retainer member 20 against the polishing surface 2*a* of the polishing pad 2.

A fluid passage 50 is in fluid communication with the pressure chamber Pr, so that pressurized fluid, such as pressurized air, is supplied into the pressure chamber Pr through the fluid passage 50. The internal pressure of the pressure chamber Pr is adjustable. Therefore, a pressing force of the retainer member 20 against the polishing pad 2 can be adjusted independently of a pressing force of the substrate W against the polishing pad 2. The elastic bag 49 of this embodiment has a quadrangular annular shape corresponding to the quadrangular substrate W, but the shape of the elastic bag 49 is not limited to the shape of this embodiment. In one embodiment, the polishing head 10 may include a plurality of retainer members 20 and a plurality of elastic bags 49. In this case, a pressing force of each retainer member 20 against the polishing pad 2 is independently adjustable by each elastic bag 49. When the substrate W is polygonal, a plurality of retainer members 20 and a plurality of elastic bags 49 may be provided for independently adjusting each side and/or each corner.

The elevating device (not shown), the polishing-head rotating motor 13, the oscillation motor 15, the table motor 8, and the torque measuring device 9 are electrically connected to the operation controller 7. Operations of the elevating device (not shown), the polishing-head rotating motor 13, the oscillation motor 15, the table motor 8, and the torque measuring device 9 are controlled by the operation controller 7.

The substrate W is polished as follows. While the polishing head 10 is rotated and the polishing table 3 is rotated together with the polishing pad 2, the polishing liquid (slurry) is supplied from the polishing-liquid supply hole 37 onto the polishing surface 2*a* of the polishing pad 2. The polishing head 10 is lowered by the elevating device (not shown) to a predetermined position (i.e., a polishing height). When a compressed gas is supplied into the pressure chamber P1 of the polishing head 10 at the predetermined position (polishing height), the elastic membrane 45 is inflated to press the substrate W against the polishing surface 2*a* of the polishing pad 2. The compressed gas is also supplied into the pressure chamber Pr, so that the elastic bag 49 presses the retainer member 20 against the polishing surface 2*a* of the polishing pad 2.

The polishing head 10 and the polishing table 3 (and the polishing pad 2) rotate in the same direction as indicated by the arrows in FIG. 1, and in this state, the polishing head 10 presses the substrate W against the polishing surface 2*a* of the polishing pad 2. With the slurry present on the polishing surface 2*a* of the polishing pad 2, the substrate W is placed in sliding contact with the polishing surface 2*a* of the polishing pad 2. The surface of the substrate W is polished by a combination of a chemical action of chemical components of the slurry and a mechanical action of abrasive grains contained in the slurry.

Figure 3:
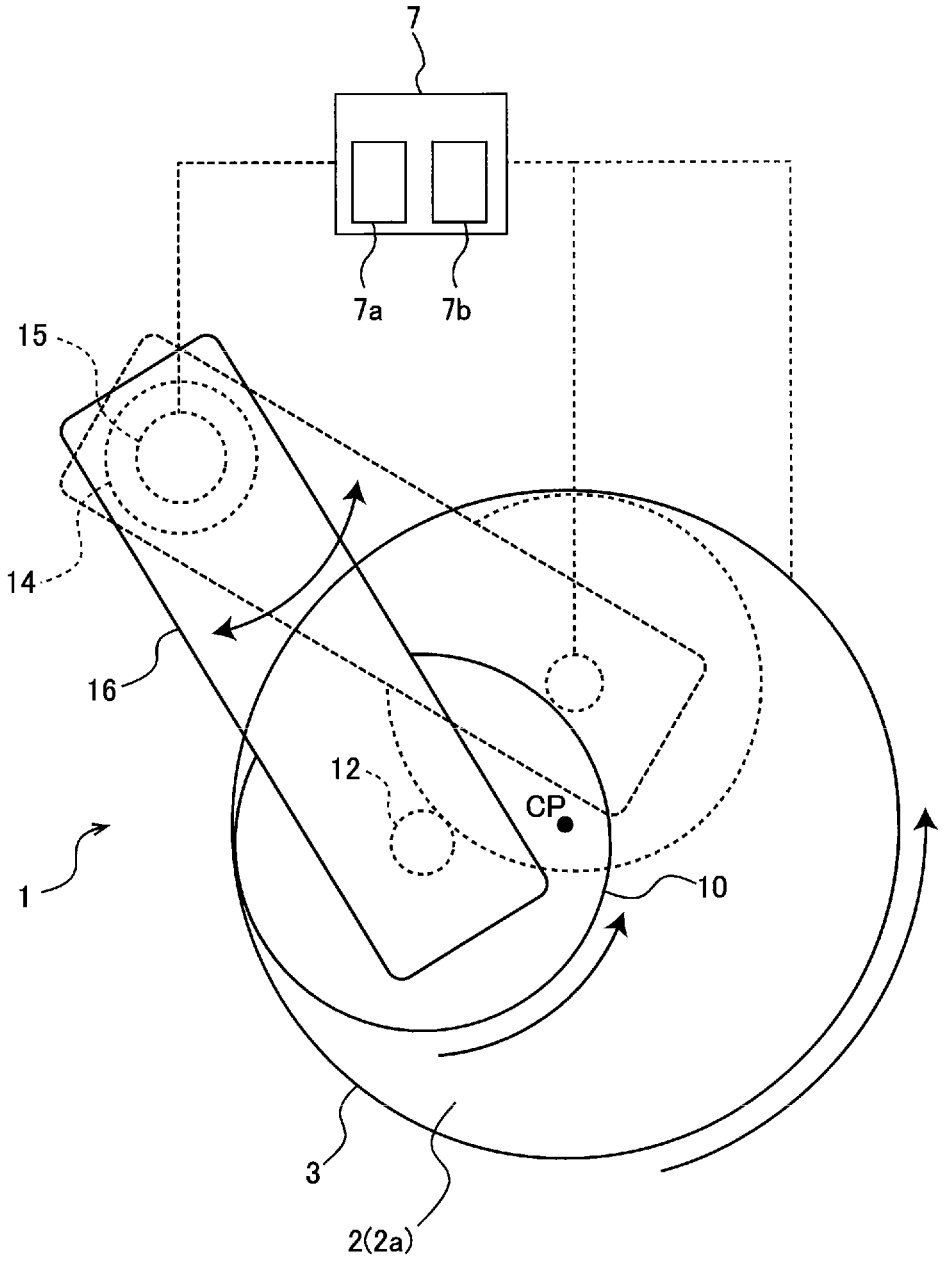
FIG. 3 is a top view of a state in which the polishing head is oscillating along a polishing surface.

During polishing of the substrate W, the operation controller 7 instructs the oscillation motor 15 to cause the polishing head 10 to oscillate along the polishing surface 2*a*. FIG. 3 is a top view of a state in which the polishing head 10 is caused to oscillate along the polishing surface 2*a*. The polishing head 10 shown in FIG. 3 is rotating about the polishing-head shaft 12. The operation controller 7 instructs the oscillation motor 15 to rotate by a predetermined angle alternately clockwise and counterclockwise, so that the polishing head 10 rotates and reciprocates around the support shaft 14 through the polishing-head oscillation arm 16. As a result, the polishing head 10 oscillates along the polishing surface 2*a*.

The polishing head 10 of the present embodiment is configured to be able to hold a substrate having a relatively large size. Therefore, as shown in FIG. 3, the size of the polishing head 10 relative to the polishing table 3 is large. During polishing, the polishing head 10 is located on the axis CP of the polishing table 3. In such an arrangement, if the polishing liquid is supplied to the polishing surface 2*a* from above the polishing pad 2, the polishing liquid may not be supplied to the entire surface, to be polished, of the substrate W held by the polishing head 10. Therefore, in this embodiment, the polishing liquid is supplied from the polishing-liquid supply hole 37 on the axis CP or near the axis CP in order to supply the polishing liquid to the entire surface, to be polished, of the substrate W. Further, in order to uniformly supply the polishing liquid to the entire surface, to be polished, of the substrate W, the polishing apparatus 1 polishes the substrate W while causing the polishing head 10 to oscillate along the polishing surface 2*a*. During the oscillation of the polishing head 10, the polishing head 10 and the substrate W are on the axis CP of the polishing table 3.

When the polishing of the substrate W is terminated, the polished substrate W is removed from the polishing head 10 and conveyed to the next step. After polishing of the substrate W, the polishing surface 2*a* of the polishing pad 2 is dressed by the dresser 30. The dresser 30 scrapes off the polishing pad 2 slightly to regenerate the polishing surface 2*a*. The polishing head 10 holds a new substrate, and the new substrate is similarly polished. In this way, the polishing of the substrate is repeated.

A polishing end point of the substrate is determined based on the change in the torque for rotating the polishing table 3. As described above, in this embodiment, the torque for rotating the polishing table 3 corresponds to the drive current for the table motor 8. The operation controller 7 determines the polishing end point of the substrate based on the change in the drive current for the table motor 8.

Figure 4:
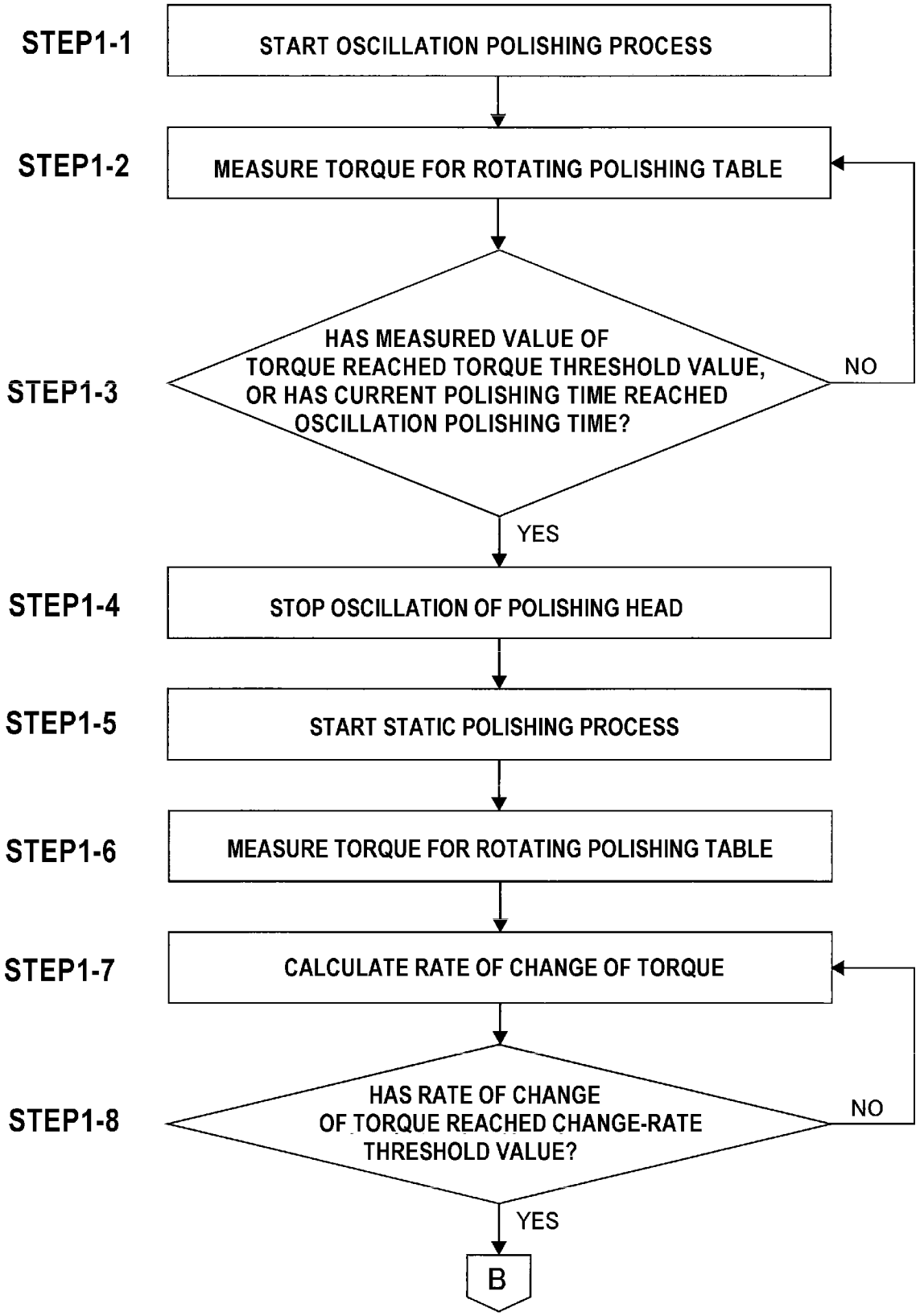
FIG. 4 is a flowchart showing an embodiment of a method of polishing a substrate and an embodiment of a method of determining a polishing end point of the substrate.
Figure 5:
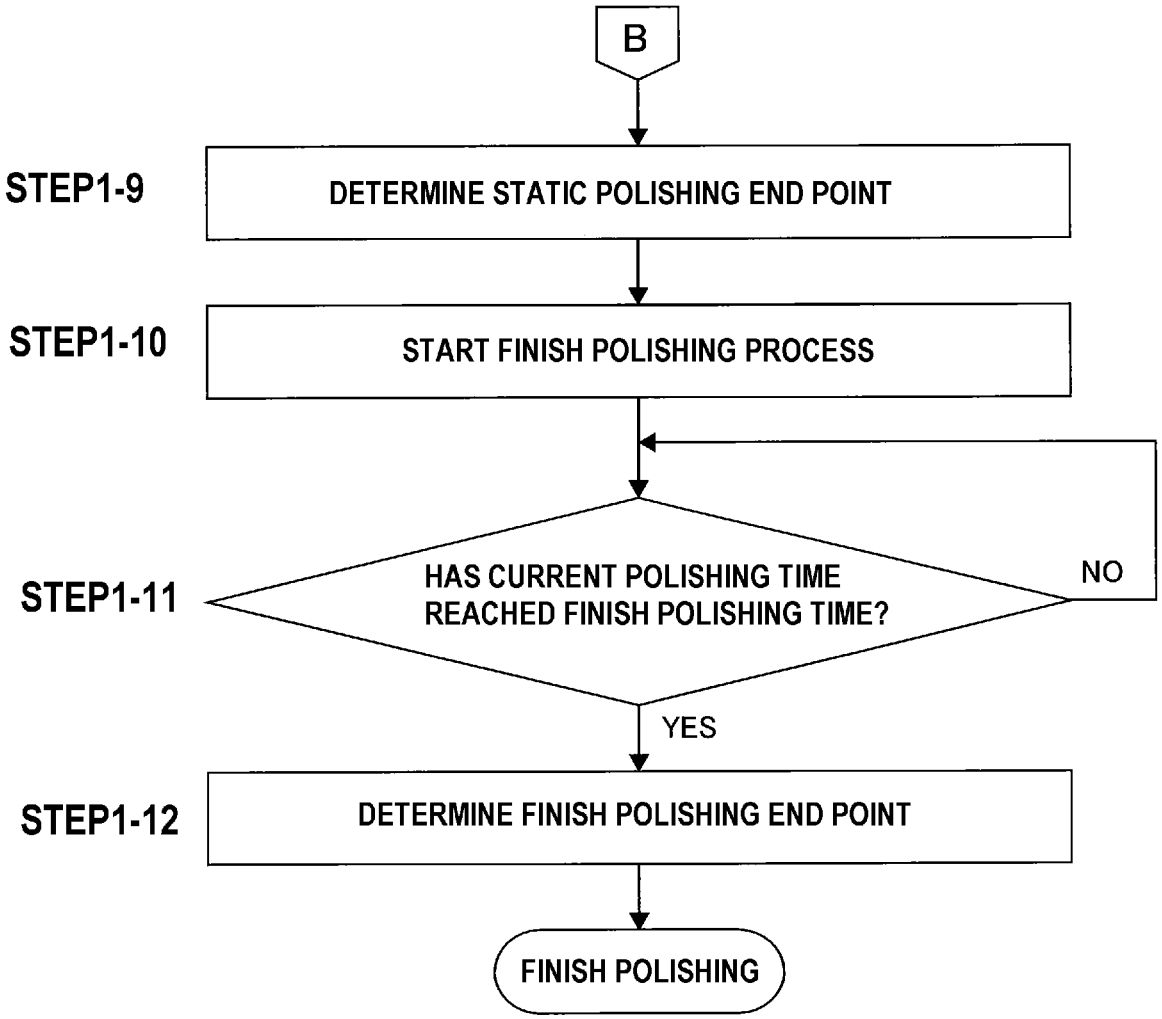
FIG. 5 is a flowchart showing an embodiment of the method of polishing the substrate and an embodiment of the method of determining the polishing end point of the substrate.

Details of the method of polishing the substrate and the method of determining the polishing end point of the substrate will be described below. FIGS. 4 and 5 are flowcharts showing an embodiment of the method of polishing the substrate and an embodiment of the method of determining the polishing end point of the substrate.

In steps 1-1 to 1-4, the polishing apparatus 1 performs an oscillation polishing process. In this specification, the oscillation polishing process is defined as a process of polishing a substrate while rotating the polishing table 3 and causing the polishing head 10 to oscillate along the polishing surface 2*a*.

In step 1-1, the polishing apparatus 1 starts the oscillation polishing process. Specifically, the table motor 8 rotates the polishing table 3 together with the polishing pad 2 at a constant rotation speed, and the polishing head 10 rotates the substrate W at a constant rotation speed. While the oscillation motor 15 causes the polishing head 10 to oscillate along the polishing surface 2*a* under certain conditions, the polishing head 10 presses the substrate W against the polishing surface 2*a* of the polishing pad 2 under certain conditions to polish the substrate W. At the same time, the retainer member 20 may be pressed against the polishing surface 2*a* of the polishing pad 2 during polish of the substrate W.

In step 1-2, while the polishing head 10 polishes the substrate W on the polishing pad 2, the torque measuring device 9 measures the torque for rotating the polishing table 3 (i.e., the drive current for the table motor 8).

In step 1-3, the operation controller 7 acquires a measured value of the torque from the torque measuring device 9 and compares the measured value of the torque with a preset torque threshold value. The measured value of the torque represents a torque required to rotate the polishing table 3 at a constant speed. When the measured value of the torque does not reach the torque threshold value, the operation controller 7 instructs the polishing apparatus 1 to continue the oscillation polishing process. After the measured value of the torque has reached the torque threshold value, the operation controller 7 instructs the oscillation motor 15 to stop the oscillation of the polishing head 10 (step 1-4). As a result, the polishing apparatus 1 terminates the oscillation polishing process.

In this embodiment, the substrate W as an object to be polished has a structure in which the torque for rotating the polishing table 3 decreases as the polishing of the substrate W progresses (the frictional force acting between the polishing pad 2 and the substrate W decreases). Therefore, in this embodiment, when the measured value of the torque is larger than the torque threshold value, the operation controller 7 instructs the polishing apparatus 1 to continue the oscillation polishing process. When the measured value of the torque is equal to or smaller than the torque threshold value, the operation controller 7 instructs the oscillation motor 15 to stop the oscillation of the polishing head 10.

In one embodiment, the substrate W as an object to be polished may have a structure in which the torque for rotating the polishing table 3 increases as the polishing of the substrate W progresses (the frictional force acting between the polishing pad 2 and the substrate W increases). In this case, when the measured value of the torque is smaller than the torque threshold value, the operation controller 7 instructs the polishing apparatus 1 to continue the oscillation polishing process. When the measured value of the torque is equal to or larger than the torque threshold value, the operation controller 7 instructs the oscillation motor 15 to stop the oscillation of the polishing head 10.

Hereinafter, in this specification, the operation of stopping the oscillation of the polishing head 10 after the measured value of the torque has reached the preset torque threshold value is referred to as an oscillation stop operation. In this embodiment, the oscillation stop operation is performed when the polishing head 10 is at a preset stop position above the polishing table 3. As described above, the torque required to rotate the polishing table 3 changes depending on the position of the polishing head 10 with respect to the polishing pad 2. When the position of the polishing head 10 at which a static polishing process (which will be described later) is performed is different for each substrate, a static polishing end point described later will vary. Therefore, stopping the polishing head 10 at the same stop position can prevent a variation in the static polishing end point in the static polishing process.

In one embodiment, in step 1-3, the operation controller 7 may compare a current polishing time with a preset oscillation polishing time, instead of comparing the measured value of the torque with the preset torque threshold value. When the current polishing time does not reach the oscillation polishing time, the operation controller 7 instructs the polishing apparatus 1 to continue the oscillation polishing process. After the current polishing time has reached the oscillation polishing time, the operation controller 7 instructs the oscillation motor 15 to stop the oscillation of the polishing head 10 (step 1-4). In this case, the oscillation stop operation is an operation of stopping the oscillation of the polishing head 10 after the current polishing time has reached the oscillation polishing time.

In steps 1-5 to 1-9, after the oscillation stop operation, the operation controller 7 instructs the polishing apparatus 1 to perform the static polishing process. In this specification, the static polishing process is defined as a process of polishing the substrate while rotating the polishing table 3 with the oscillation of the polishing head 10 stopped.

In step 1-5, the polishing apparatus 1 starts the static polishing process. The static polishing process is different from the oscillation polishing process in that the polishing head 10 is not oscillating. Other operations are the same as those of the oscillation polishing process. Specifically, the polishing head 10, whose oscillation is stopped by the oscillation stop operation, polishes the substrate W by pressing the substrate W against the polishing surface 2*a* of the polishing pad 2 rotated together with the polishing table 3 while the polishing head 10 is rotating the substrate W. The position of the polishing head 10 in the static polishing process is the preset stop position discussed previously. The oscillation polishing process and the static polishing process are performed substantially sequentially.

In steps 1-6, the torque measuring device 9 measures the torque for rotating the polishing table 3 (i.e., measures the drive current for the table motor 8) while the polishing head 10 polishes the substrate W.

In step 1-7, the operation controller 7 acquires a measured value of the torque from the torque measuring device 9, and calculates a rate of change of the torque with respect to polishing time (i.e., a rate of change of the torque) based on the measured value of the torque.

In step 1-8, the operation controller 7 compares the rate of change of the torque with a change-rate threshold value. When the rate of change of the torque does not reach the change-rate threshold value, the operation controller 7 instructs the polishing apparatus 1 to continue the static polishing process.

In step 1-9, the operation controller 7 determines the static polishing end point which is a point in time at which the rate of change of the torque reaches the change-rate threshold value. Thereafter, the operation controller 7 instructs the polishing apparatus 1 to terminates the static polishing process. In the static polishing process, the oscillation of the polishing head 10 has been stopped. Therefore, the fluctuation of the torque according to the position of the polishing head 10 can be removed, and the operation controller 7 accurately determines the static polishing end point.

In this embodiment, the substrate W to be polished has a structure in which the rate of change of the torque decreases as the static polishing process progresses. Therefore, in this embodiment, when the rate of change of the torque is larger than the change-rate threshold value, the operation controller 7 instructs the polishing apparatus 1 to continue the static polishing process. The operation controller 7 determines the static polishing end point which is a point in time at which the rate of change of the torque decreases to reach the change-rate threshold value.

In one embodiment, the substrate W to be polished has a structure in which the rate of change of the torque increases as the static polishing process progresses. In this case, when the rate of change of the torque is smaller than the change-rate threshold value, the operation controller 7 instructs the polishing apparatus 1 to continue the static polishing process. The operation controller 7 determines a static polishing end point which is a point in time at which the rate of change of the torque increases to reach the change-rate threshold value.

In steps 1-10 to 1-12, after the static polishing process, the operation controller 7 instructs the polishing apparatus 1 to perform a finish polishing process. In the polishing of the substrate W having the structure in which the rate of change of the torque decreases as the static polishing process progresses, the frictional force acting between the polishing pad 2 and the substrate W does not change significantly (i.e., the torque for rotating the polishing table 3 does not change significantly) after the static polishing end point has elapsed. This static polishing end point indicates a point in time at which the material of the polished surface of the substrate W has changed. Also in the polishing of the substrate W having the structure in which the rate of change of the torque increases as the static polishing process progresses, the static polishing end point indicates a point in time at which the material of the polished surface of the substrate W has changed. The flatness of the surface to be polished can be improved by performing the finish polishing process of further polishing the substrate W even after the static polishing end point has elapsed.

In step 1-10, the polishing apparatus 1 starts the finish polishing process. The finish polishing process is substantially the same operation as the oscillation polishing process. Specifically, while the oscillation motor 15 causes the polishing head 10 to oscillate along the polishing surface 2*a*, the polishing head 10 rotates the substrate W and presses the substrate W against the polishing surface 2*a* of the polishing pad 2 which rotates together with the polishing table 3 to polish the substrate W. In one embodiment, the finish polishing process may be performed with the oscillation of the polishing head 10 stopped. The static polishing process and the finish polishing process are performed substantially sequentially. Although the oscillation of the polishing head 10 may be stopped for an entire time as in the static polishing process, or may be stopped non-continuously during the finish polishing process, the flatness of the surface to be polished can be improved by the oscillation of the polishing head 10.

In step 1-11, the operation controller 7 compares the current polishing time with a finish polishing time. When the current polishing time does not reach the finish polishing time, the operation controller 7 instructs the polishing apparatus 1 to continue the finish polishing process.

Figure 6:
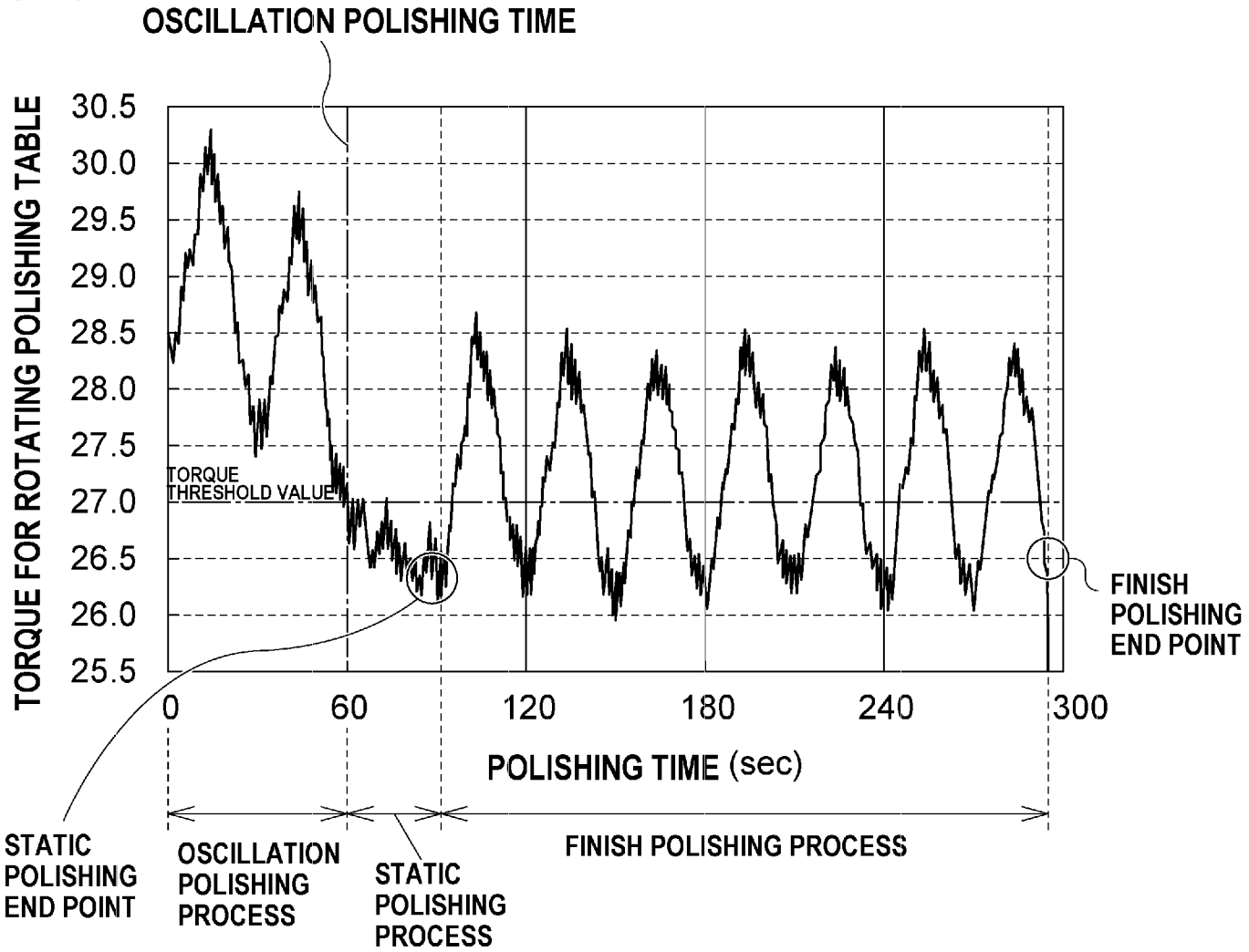
FIG. 6 is a diagram showing an example of a change in torque for rotating a polishing table in steps 1-1 to 1-12.

In step 1-12, the operation controller 7 determines a finish polishing end point which is a point in time at which the current polishing time has reached the finish polishing time. The finish polishing time is determined based on the static polishing end point. Specifically, the operation controller 7 determines the finish polishing time by adding a preset fixed time to a polishing time at the static polishing end point. The fixed time is determined based on experiments or past polishing results. In another example, the operation controller 7 may determine the finish polishing time by multiplying a polishing time at the static polishing end point by a preset coefficient. After the finish polishing end point is determined, the operation controller 7 instructs the polishing apparatus 1 to terminate the finish polishing process, whereby the polishing of the substrate W is terminated. FIG. 6 shows an example of the change in the torque for rotating the polishing table 3 in the steps 1-1 to 1-12. The example in FIG. 6 shows the change in the torque in the case where the torque for rotating the polishing table 3 decreases as the polishing progresses.

The torque threshold value and the oscillation polishing time are determined based on experiments or past polishing results, and are set near the static polishing end point. This can make it possible to accurately determine the static polishing end point while shortening a time for stopping the oscillation of the polishing head 10. As a result, the polishing apparatus 1 can accurately determine the polishing end points such as the static polishing end point and the finish polishing end point while maintaining polishing performance. In order to reduce surface defects (scratches, etc.) of the substrate W, a water polishing process may be performed in a final stage of the finish polishing process or after the finish polishing process. The water polishing process is a process of placing the substrate W in sliding contact with the polishing surface 2*a* of the polishing pad 2 with a lowered pressing force of the polishing head 10 on the substrate W while supplying pure water, in place of slurry, to the polishing surface 2*a* of the polishing pad 2.

Figure 7:
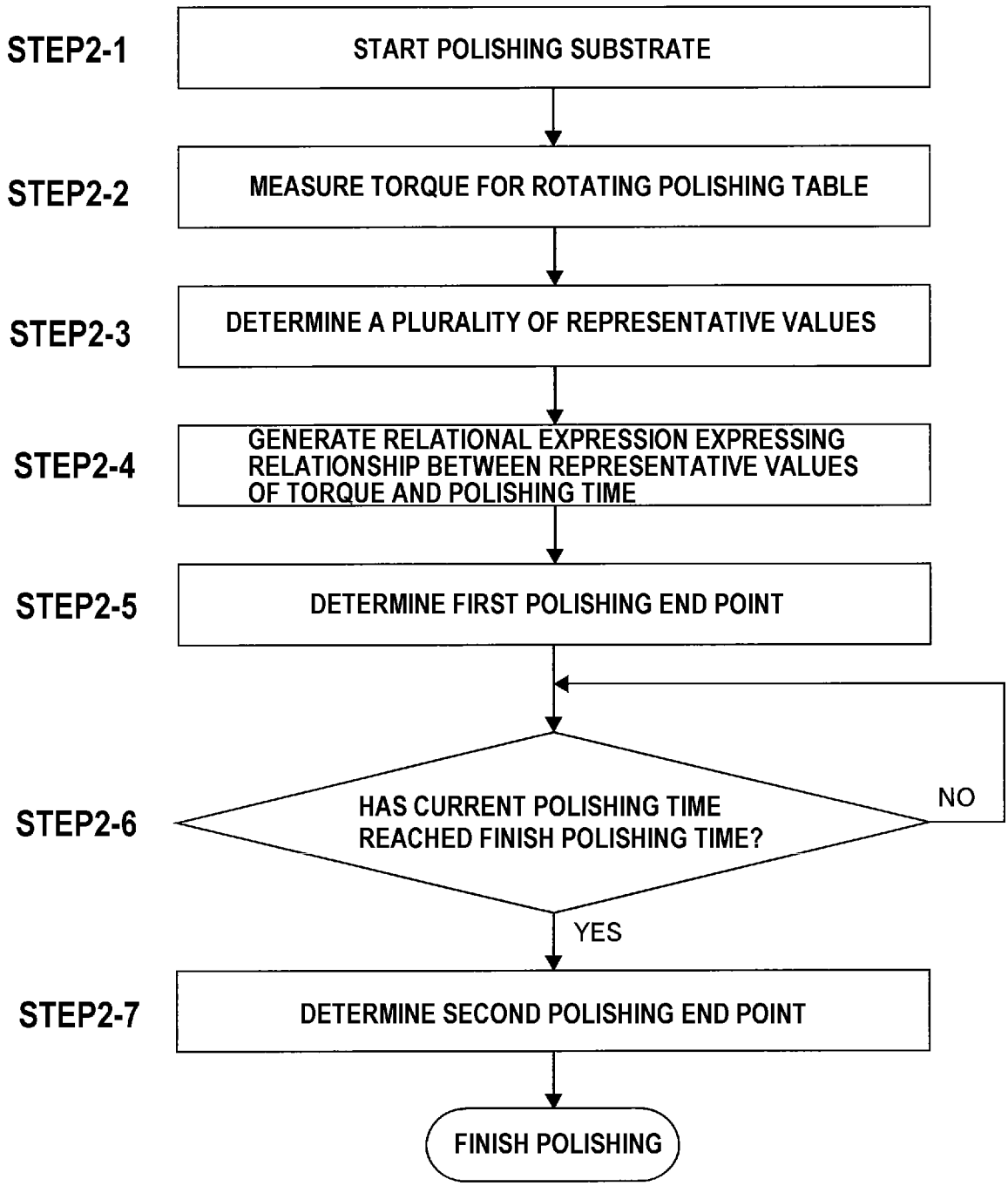
FIG. 7 is a flowchart showing another embodiment of a method of polishing the substrate and another embodiment of a method of determining the polishing end point of the substrate.

Next, another embodiment of a method of polishing the substrate and another embodiment of a method of determining the polishing end point of the substrate will be described. FIG. 7 is a flowchart showing another embodiment of the method of polishing the substrate and another embodiment of the method of determining the polishing end point of the substrate.

In step 2-1, the operation controller 7 instructs the polishing apparatus 1 to polish the substrate W. The polishing in embodiment is performed as follows. The table motor 8 rotates the polishing table 3 together with the polishing pad 2 at a constant rotation speed, and the polishing head 10 rotates the substrate W at a constant rotation speed. While the oscillation motor 15 causes the polishing head 10 to oscillate along the polishing surface 2*a* under certain conditions, the polishing head 10 presses the substrate W against the polishing surface 2*a* of the polishing pad 2 under certain conditions to polish the substrate W. Further, at the same time, the retainer member 20 may be pressed against the polishing surface 2*a* of the polishing pad 2 during polishing of the substrate W. Also in this embodiment, the polishing head 10 and the substrate W are on the axis CP of the polishing table 3 during the oscillation of the polishing head 10.

In step 2-2, while the polishing head 10 polishes the substrate W on the polishing pad 2, the torque measuring device 9 measures a torque for rotating the polishing table 3 (i.e., measures the drive current for the table motor 8).

In step 2-3, the operation controller 7 acquires measured values of the torque from the torque measuring device 9, and determines a plurality of representative values of the torque from the measured values of the torque. In this embodiment, the representative values of the torque are a plurality of local minimum values of the torque. In one embodiment, the representative values of the torque may be a plurality of local maximum values of the torque or a plurality of moving average values of the torque.

In step 2-4, the operation controller 7 generates a relational expression expressing relationship between the representative values of the torque and polishing time.

Figure 8:
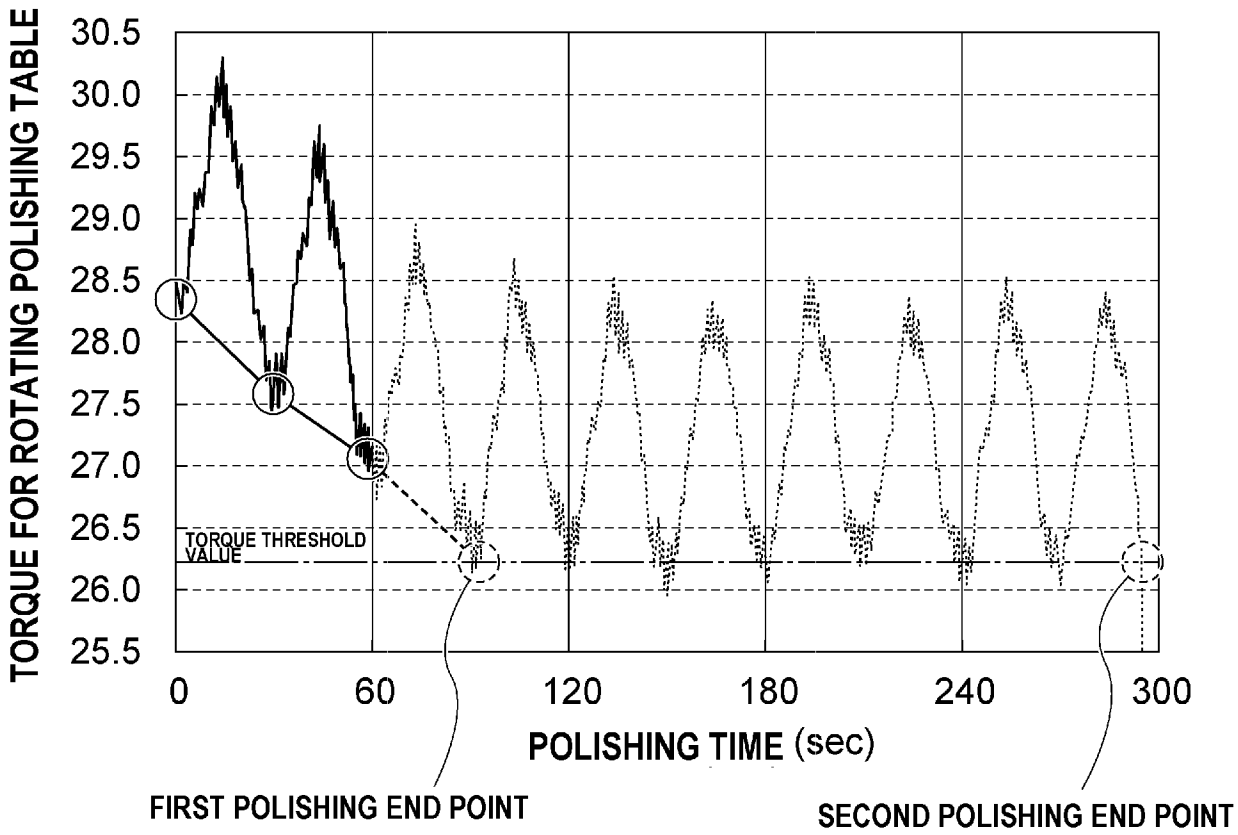
FIG. 8 is a diagram showing a relationship between the torque for rotating the polishing table and a first polishing end point.
Figure 9:
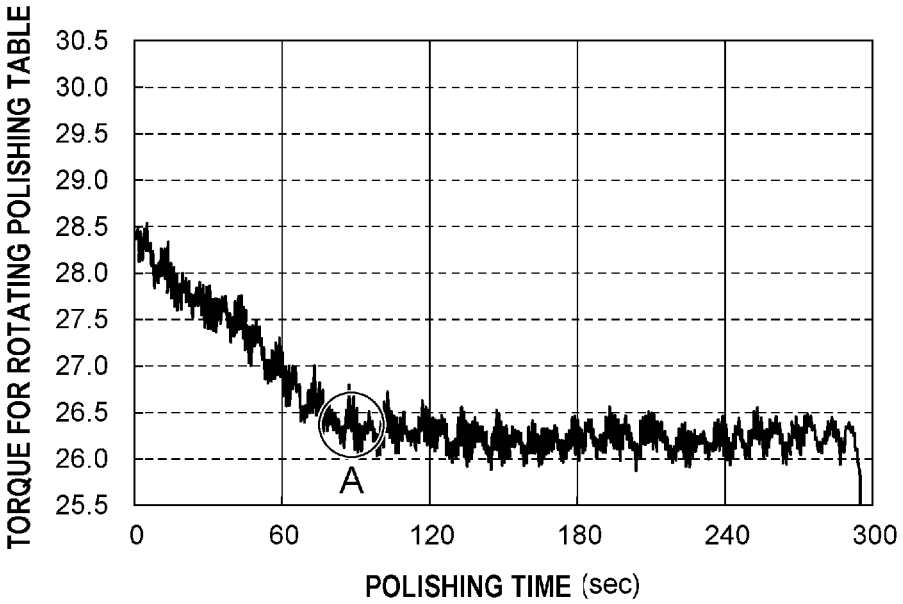
FIG. 9 is a diagram showing a change in torque for rotating a polishing table when a substrate is polished with no oscillation of a polishing head.
Figure 10:
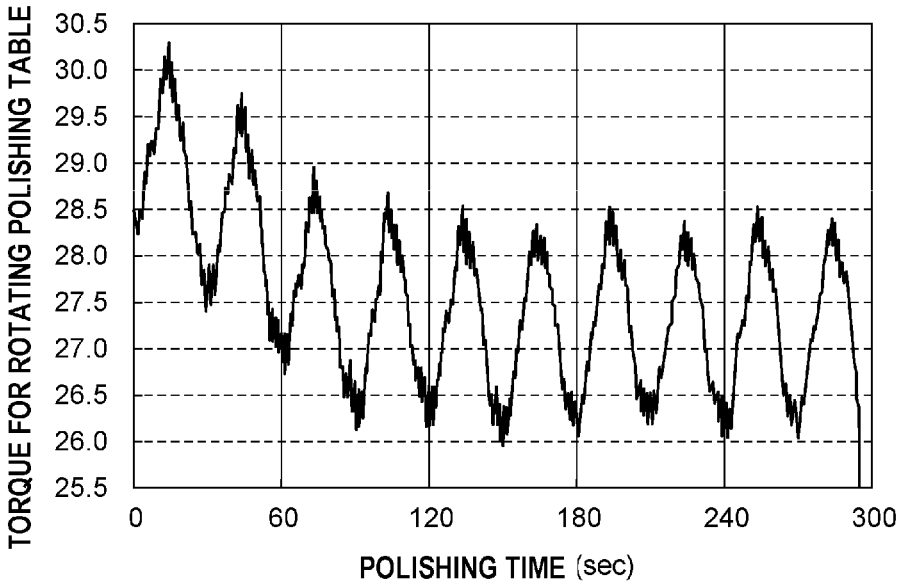
FIG. 10 is a diagram showing a change in the torque for rotating the polishing table when a substrate equivalent to the substrate in FIG. 9 is polished while the polishing head is oscillating along a polishing surface of a polishing pad.

In step 2-5, the operation controller 7 determines a first polishing end point which is a point in time at which a predicted value of the torque calculated from the relational expression reaches a preset torque threshold value. FIG. 8 is a diagram showing a relationship between the torque for rotating the polishing table 3 and the first polishing end point. The first polishing end point is a point in time at which the frictional force acting between the polishing pad 2 and the substrate W is expected to become constant. The torque threshold value is determined based on experiments or past polishing results.

In step 2-6, the operation controller 7 compares the current polishing time with the finish polishing time. When the current polishing time does not reach the finish polishing time, the operation controller 7 instructs the polishing apparatus 1 to continue the finish polishing process.

In step 2-7, the operation controller 7 determines a finish polishing end point (a second polishing end point) which is a point in time at which the current polishing time has reached the finish polishing time. The finish polishing time is determined based on the first polishing end point. Specifically, the operation controller 7 determines the finish polishing time by adding a preset fixed time to a polishing time at the first polishing end point. The fixed time is determined based on experiments or past polishing results. In another example, the operation controller 7 may determine the finish polishing time by multiplying a polishing time at the first polishing end point by a preset coefficient. After the second polishing end point is determined, the operation controller 7 instructs the polishing apparatus 1 to terminate the finish polishing process, whereby the polishing of the substrate W is terminated. In order to reduce surface defects (scratches, etc.) of the substrate W, the water polishing process may be performed in a final stage of the finish polishing process or after the finish polishing process. The water polishing process is a process of placing the substrate W in sliding contact with the polishing surface 2*a* of the polishing pad 2 with a lowered pressing force of the polishing head 10 on the substrate W while supplying pure water, in place of slurry, to the polishing surface 2*a* of the polishing pad 2.

In this embodiment, the predicted value of the torque is calculated based on the measured values of the torque, and the first polishing end point is determined based on the predicted value. Therefore, in this embodiment, the first polishing end point can be accurately determined while the polishing head 10 is oscillating. As a result, the polishing apparatus 1 can accurately determine the polishing end points such as the first polishing end point and the second polishing end point while maintaining polishing performance.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A method of polishing a substrate, comprising:

rotating a polishing table supporting a polishing pad; and polishing the substrate by pressing the substrate against a polishing surface of the polishing pad by a polishing head, wherein polishing the substrate includes:

an oscillation polishing process of polishing the substrate while causing the polishing head to oscillate along the polishing surface;

a static polishing process of polishing the substrate with the oscillation of the polishing head stopped;

a finish polishing process performed after the static polishing process, the finish polishing process comprising determining a finish polishing end point by adding a preset fixed time to a polishing time at the static polishing end point or multiplying a polishing time at the static polishing end point by a preset coefficient, the static polishing process is performed after the oscillation polishing process, and the static polishing process comprises determining a static polishing end point which is a point in time at which a rate of change of torque for rotating the polishing table has reached a change-rate threshold value.

2. The method according to claim 1, wherein polishing the substrate comprises an oscillation stop operation which stops the oscillation of the polishing head after the torque has reached a preset torque threshold value or after a current polishing time has reached a preset oscillation polishing time.

3. The method according to claim 2, wherein the oscillation stop operation comprises stopping the oscillation of the polishing head when the polishing head is at a preset stop position above the polishing table.

4. The method according to claim 1, wherein determining the static polishing end point comprises determining a point in time at which the rate of change decreases to reach the change-rate threshold value.

5. The method according to claim 1, wherein determining the static polishing end point comprises determining a point in time at which the rate of change increases to reach the change-rate threshold value.

6. The method according to claim 1, wherein the finish polishing process comprises polishing the substrate while causing the polishing head to oscillate along the polishing surface.

7. The method according to claim 1, wherein the polishing head is on an axis of the polishing table while the polishing head is oscillating.

8. A polishing apparatus for polishing a substrate, comprising:

a polishing table for supporting a polishing pad;

a table motor configured to rotate the polishing table;

a torque measuring device configured to measure a torque for rotating the polishing table;

a polishing head configured to polish the substrate by pressing the substrate against a polishing surface of the polishing pad;

a polishing-head oscillation arm coupled to the polishing head;

an oscillation motor coupled to the polishing-head oscillation arm and configured to cause the polishing head to oscillate along the polishing surface;

an operation controller configured to control an operation of the polishing apparatus, wherein the operation controller is configured to:

instruct the polishing apparatus to perform an oscillation polishing process of polishing the substrate while rotating the polishing table and causing the polishing head to oscillate along the polishing surface;

instruct the polishing apparatus to perform, after the oscillation polishing process, a static polishing process of polishing the substrate while rotating the polishing table with the oscillation of the polishing head stopped, and determine a static polishing end point which is a point in time at which a rate of change of the torque for rotating the polishing table has reached a change-rate threshold value during the static polishing process;

instruct the polishing apparatus to perform a finish polishing process after the static polishing process; and determine a finish polishing end point by adding a preset fixed time to a polishing time at the static polishing end point or multiplying a polishing time at the static polishing end point by a preset coefficient.

9. The polishing apparatus according to claim 8, wherein the operation controller is configured to instruct the oscillation motor to stop the oscillation of the polishing head after the torque has reached a preset torque threshold value or after a current polishing time has reached a preset oscillation polishing time.

10. The polishing apparatus according to claim 9, wherein the operation controller is configured to instruct the oscillation motor to stop the oscillation of the polishing head when the polishing head is at a preset stop position above the polishing table.

11. The polishing apparatus according to claim 8, wherein the polishing head is on an axis of the polishing table.

12. The polishing apparatus according to claim 8, wherein the operation controller is configured to instruct the polishing apparatus to perform the finish polishing process while causing the polishing head to oscillate along the polishing surface.

* * * * *